United States Patent [19]

Takeyama et al.

[11] 4,275,841

[45] Jun. 30, 1981

[54] BURNER FOR COMBUSTION APPARATUS

[75] Inventors: Toshiro Takeyama; Shigemori Ohtani, both of Sendai, Japan

[73] Assignee: Kabushikikaisha Ohkawara Seisakusho, Yoshida, Japan

[21] Appl. No.: 969,544

[22] Filed: Dec. 14, 1978

[30] Foreign Application Priority Data

Dec. 28, 1977 [JP] Japan ..... 52/157456

[51] Int. Cl.[3] ..... B05B 7/04

[52] U.S. Cl. ..... 239/431; 239/432; 239/567; 239/568

[58] Field of Search ..... 239/429, 430, 431, 432, 239/567, 568

[56] References Cited

U.S. PATENT DOCUMENTS

| | | | |
|---|---|---|---|
| 479,922 | 8/1892 | Sugg | 239/567 |
| 1,012,436 | 12/1911 | Ransome et al. | 239/432 |
| 1,416,574 | 5/1922 | Oney | 239/432 |
| 1,592,448 | 7/1926 | DeBus | 239/433 |
| 2,200,673 | 5/1940 | Kinder | 239/430 |
| 2,290,785 | 7/1942 | Turpin | 239/430 |
| 2,511,755 | 6/1950 | Turpin et al. | 239/431 |
| 3,885,918 | 5/1975 | Isahaya | 239/431 |

*Primary Examiner*—Bruce H. Stoner, Jr.
*Assistant Examiner*—Michael J. Forman
*Attorney, Agent, or Firm*—Stevens, Davis, Miller & Mosher

[57] ABSTRACT

The present invention relates to a burner for combustion apparatus employing a so-called multistage atomization system in which a tip of a nozzle is blocked, an outer peripheral surface has an inclined portion formed therein, fuel is forced in a string-like pattern through a multiplicity of outflow passageways formed on the inclined portion while at the same time the flow of air is substantially brought to intersect thereto at right angles for atomized disintegration and the fuel flowing along the inclined portion is formed into substances in the form of film and subject to filmed disintegration at the top of a frustoconical portion.

2 Claims, 12 Drawing Figures

BURNER FOR COMBUSTION APPARATUS

BACKGROUND OF THE INVENTION

A typical burner for combustion apparatus in metal heating furnaces, ceramic furnaces and the like most extensively used is of the air atomizing type in which fuel is atomized by the flow of high speed air to burn a group of thus atomized substances. The performance of such a burner is decided by the atomization performance and combustion performance of the fuel. If the atomization performance is poor, the particles of fuel become large, failing to complete burning within a predetermined period of time and as a result, soot and smoke may sometimes result.

In addition, in order to burn the group of particles poorly atomized as described above, a large quantity of excess air is required to worsen the thermal efficiency, as a consequence of which the fuel is not only consumed wastefully but material to be heated in the combustion apparatus is sometimes contaminated.

In general, the atomization performance of the air atomizing type burner is decided by the ratio Qa/Qb between the air flow rate Qa ($m^3hr$) and the amount of fuel consumption Qb ($m^3/hr$). If this ratio is small, the atomization performance is poor, and if the ratio is large, say, $2\times10^3$, Sauter's mean diameter $\bar{d}_{32}(=\bar{Z}nd^3/\bar{Z}nd^2)$ of body area of the group of particles is made constant. It will be noted that the value of the ratio is about twenty percent of the theoretical amount of air required for combustion. The greater the relative speed (Ua−Ub) between the air speed Ua (m/sec) for atomization (which is decided by pressure of a blower) and the linear speed Ub (m/sec) of fuel forced out of a nozzle orifice, the smaller will be Sauter's mean diameter $\bar{d}_{32}$. Hence, the atomization performance is decided extremely close to the nozzle outlet where gas and air come into contact.

In prior art atomizing type burners, the injecting direction of fuel is parallel to the direction of air flow.

In the burners in which the injecting direction of fuel is parallel to the direction of air flow as mentioned above, liquid hole-diameter must be reduced to about 1-2 mm in order to enhance the atomization performance. Therefore, a limit in the amount of fuel consumption is 10 to 20 l/hr. In burners of large capacity more than 100 l/hr, the liquid hole-diameter must be made large and hence, the atomization performance is naturally decreased. Also, in order to increase the capacity of the burner, a multi-hole type burner of small liquid hole-diameter is employed. In this type of burner, however, contact between gas and liquid is bad and it is not possible to expect atomized disintegration of the fuel.

The present invention overcomes the disadvantages noted above with respect to prior art devices. That is, in accordance with the burner for combustion apparatus of the present invention, the tip of the nozzle is blocked, an outer peripheral surface has an inclined portion inclined upstream of the air flow, fuel is forced in a string-like pattern through a multiplicity of outflow passageways formed on the inclined portion while at the same time the flow of air is substantially brought to intersect thereto at right angles to disintegrate the fuel in an atomized pattern. The fuel flowing along the inclined portion is formed into substances in the form of film and subject to filmed disintegration at the top of a frustoconical portion.

That is, in accordance with the present burner, the fuel to be burned impinges upon air and flows along the inclined portion to be formed into a film-like pattern so that even if pressure of the air for atomizing fuel is decreased, the fuel may be atomized into a group of extremely fine particles. Thus, the present invention possesses an advantage that the burning performance may be enhanced. Moreover, the provision of plural stages of the frustoconical portions cause the fuel formed into a film-like pattern to repeat the atomization phenomenon and the fuel impinges upon air, which leads to the employment of the so-called "multistage atomization system". In this manner, atomization of fuel is further promoted, which constitutes another advantage of the invention.

BRIEF SUMMARY OF THE INVENTION

The burner in accordance with the present invention employs a so-called multistate atomization system in which the tip of the nozzle is blocked, an outer peripheral surface has an inclined portion formed therein, fuel is forced in a string-like pattern through a multiplicity of outflow passageways formed on the inclined portion while at the same time the flow of air is substantially brought to intersect thereto at right angles for atomized disintegration and the fuel flowing along the inclined portion is formed into substances in the form of film and subject to filmed disintegration at the top of a frustoconical portion. It is therefore possible to obtain a burning burner which can atomize a group of extremely fine particles even if pressure of air for atomization is low and which can provide excellent combustion performance.

BRIEF DESCRIPTION OF THE SEVERAL VIEWS OF THE DRAWINGS

The present invention will be made more clearly by reference to the accompanying drawings in which.

DETAILED DESCRIPTION OF THE EMBODIMENTS

Figure 1:
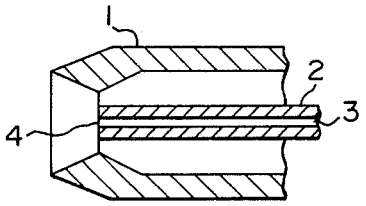
FIGS. 1 through 3 are respectively longitudinal sectional views showing examples of conventional burners.
Figure 2:
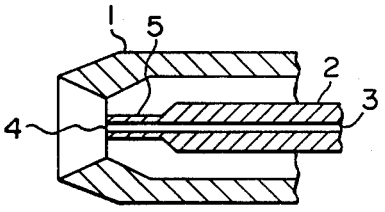
PRIOR ART FIG. 2
Figure 3:
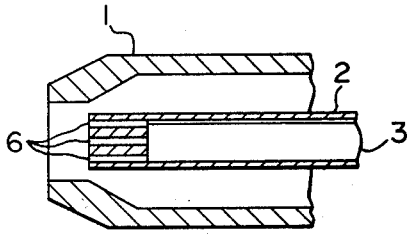
PRIOR ART FIG. 3

In conventional air atomizing type burners, the injecting direction of fuel is parallel to the direction of air flow as shown in FIGS. 1 to 3. In the case of FIG. 1, a burner nozzle 2 is positioned in a central portion interiorly of an atomizer 1, and an opening 4 at the extreme end of a fuel passageway 3 formed axially of the burner nozzle 2 is bored in an extreme end surface of the nozzle 2. In the case of FIG. 2, the burner nozzle 2 has a small diameter portion 5 formed at the extreme end of the burner nozzle 2. In the case of FIG. 3, the burner nozzle : has small diameter liquid holes 6 . . . parallel with the ıozzle 2 bored at the extreme end thereof.

In any of these burner nozzles, the injecting direction ›f fuel is parallel to the direction of air flow, and the iquid hole-diameter is 1 to 2 mm in order to have better .tomization performance, and a limit in the amount of ıuel consumption is 10 to 20 l/hr. In burners of large :apacity of more than 100 l/hr, the liquid hole-diameter nust be made larger and hence, the atomization perfor- nance is naturally decreased. Further, in a multi-hole ype burner of small liquid hole-diameter as shown in ⁻IG. 3, contact between gas and liquid is bad and it is ıot possible to expect atomized disintegration of the ıuel.

Figure 11:
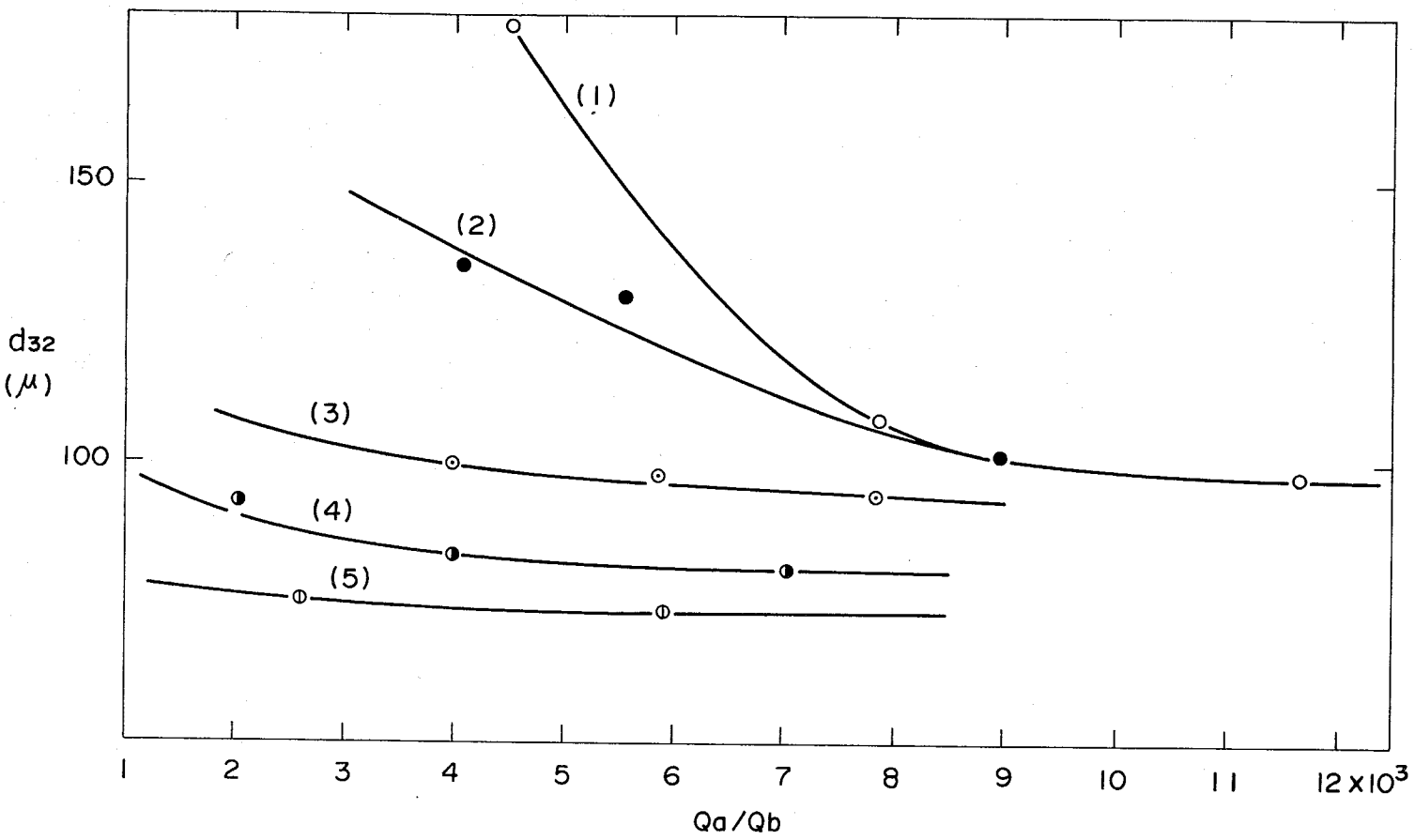
FIGS. 11 and 12 are respectively characteristic curves for atomization in connection with various burners.
Figure 12:
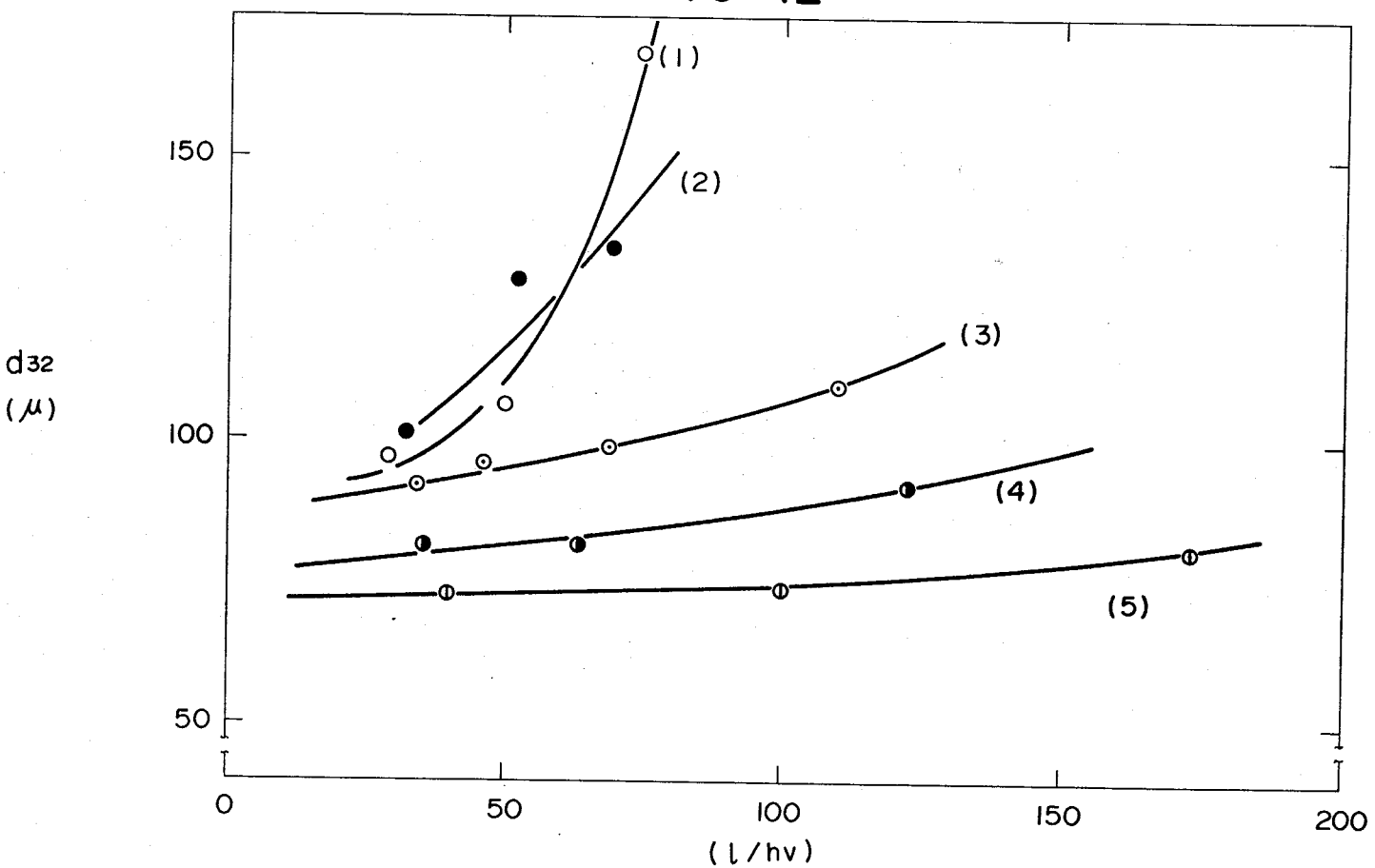

To give comparison of atomization characteristics in ⁄arious burners, in FIG. 11 the axis of the ordinate lenotes Sauter's mean diameter $\bar{d}_{32}(\mu)$ of body area vhile the axis of the abscissa, the ratio between flow ate and volume Qa/Qb; and in FIG. 12 the axis of .bscissa denotes the amount of fuel consumption (l/hr).

In prior art burners shown in FIGS. 1 and 2, it is lifficult to make the average diameter $d_{32}$ of the group ›f particles to a value less than 100$\mu$ even if the ratio of low rate (Qa/Qb) is considerably large as shown in :urves (1) and (2) in FIG. 11. As shown in curves (1) .nd (2) in FIG. 12, droplets rapidly become coarse vhen the amount of fuel consumption is above, about 30 /hr to decreasing the atomization performance, and as result, the combustion performance is naturally de- :reased and hence, the combustion apparatus is not able o exhibit its sufficient function.

In view of the foregoing, the present invention has ›een proposed. The invention will now be described by vay of illustrated embodiments. The most fundamental onstruction of the present invention is shown in FIG. . That is, an axial fuel passageway 12 is disposed within nozzle 11 positioned interiorly of an atomizer (not hown), and the nozzle 11 has its tip blocked by a frusto- onical portion 13. The frustoconical portion 13 has its ıuter peripheral surface formed with an inclined por- ion 14, which is upwardly inclined from the base end ɔward the uppermost end, the inclined portion 14 eing formed with a cut surface 15 at the inclined upper nd thereof. This cut surface 15 may be in the form of a ertical surface intersecting at right angles to the axial irection of the nozzle 11 or in the form of a circular urface outwardly swollen. The frustoconical portion 3 is formed with a plurality of outflow passageways of ıel or liquid-holes 16 . . . which provide a communica- on between the flow passageway 12 and the exterior. :ach outflow passageway 16 has an open end portion 6' located in the midst of the inclined portion 14. Fuel :d under pressure through the passageway 12 is forced ı a string-like pattern through the open end portion 16' ia a number of outflow passageways 16.

On the other hand, air passing through an air cavity ırrounded by the inner peripheral surface of the atom- :er and the outer peripheral surface of the nozzle 11 ows along the length of the nozzle 11 to thereby first ffect atomized disintegration as a first step with respect › the fuel forced through the liquid-holes 16. On the ther hand, the remaining fuel not subjected to the tomized disintegration flows in a film-like pattern long the inclined portion 14 and disengages from the ⁄all at the top portion 17 of the frustoconical portion ıto contact with the air flow to effect filmed disintegra- on as a second step. That is, the multi-stage atomiza- on may be accomplished to materially enhance the atomization performance of fuel whereby the combus- tion performance may also be highly enhanced. It will be noted that the nozzle formed with the cut surface 15 produces an eddy of flame to provide a better flame holding effect.

Figure 4:
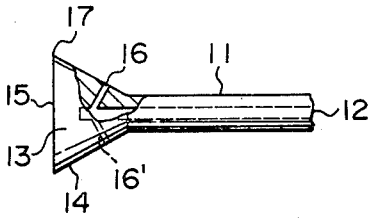
PRIOR ART FIG. 4
FIG. 4 is a partially cutaway side view of a first embodiment in accordance with the present invention.
Figure 5:
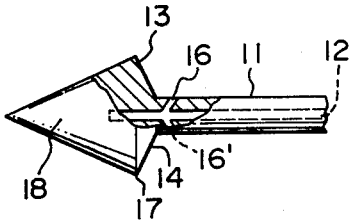
FIG. 5 is a partially cutaway side view of a second embodiment is accordance with the present invention.

In accordance with a second embodiment of the pres- ent invention shown in FIG. 5, open end portions 16' of outflow passageways 16 . . . of fuel are bored in the base end of the inclined portion 14, and the extreme end of the frustoconical portion 13 comprises a gradually diameter-reduced tapered conical portion 18 instead of the cut surface for accomplishment of two-stage atom- ization similarly to the FIG. 4 embodiment.

Figure 6:
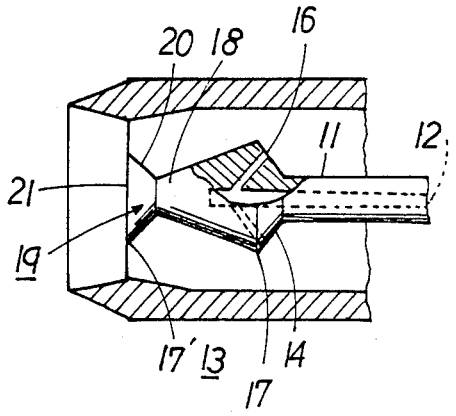
FIG. 6 is a partially cutaway side view of a third embodiment in accordance with the present invention.

In a third embodiment of the present invention shown in FIG. 6, a further second frustoconical portion 19 is provided at the extreme end of the tapered conical portion 18. This second frustoconical portion 19 has a second inclined portion 20 of which the outer peripheral surface upwardly inclines from the base end toward the uppermost end similarly to the inclined portion 14, and the second inclined portion 20 has a second cut surface 21 formed at the extreme end thereof. Thus, this is the multistage atomization system in which even if there is an extremely small amount of fuel flowing over the tapered conical portion 18, this fuel is moved up by air stream along the second inclined portion 20 of the second frustoconical portion 19 and as a result, filmed disintegration occurs at the top portion 17' of the por- tion 19. Accordingly, the atomization performance may be further increased more than is attained by the afore- mentioned first and second embodiments.

Figure 7:
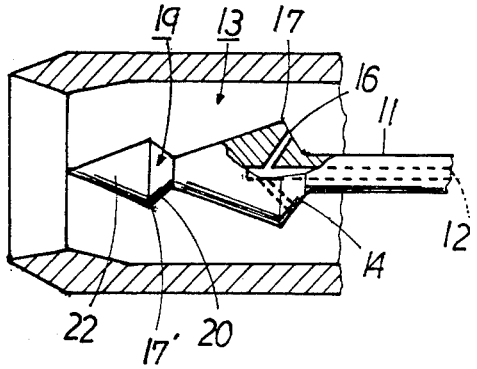
FIG. 7 is a partially cutaway side view of a fourth embodiment in accordance with the present invention.

A fourth embodiment of the present invention shown in FIG. 7 provides an arrangement wherein a second tapered conical portion 22 is disposed at the extreme end of the second frustoconical portion 19 in the above- mentioned third embodiment, which is also of the multi- stage atomization system similarly to the case of FIG. 3, affording excellent atomization performance.

As is apparent from the foregoing, the present inven- tion employs the so-called multistage atomization sys- tem in which fuel is forced to intersect substantially at right angles to the flowing direction of air to effect atomized disintegration and fuel flowing along the in- clined portion is formed into a film which comes into contact with air at the top portion of the frustoconical portion to effect filmed disintegration. Accordingly, with a marked increase in the atomization performance of the burner, the combustion performance may be highly increased at a portion where the excess air factor is small. For example, in the heating furnace or the like, the amount of fuel consumption may be reduced and the internal temperature may be stabilized, and in addition, material to be heated is never contaminated by fuel. The performance having the features as described may be further increased in effect by the provision of frustocon- ical portions in a multistage fashion. Moreover, since the amount of fuel supply may be determined over a wide range from a small capacity to a large capacity by suitably determining the inner diameter of a multiplicity of outflow passageways 16 . . . or by selecting the num- ber of the outflow passageways 16, the device of the invention may be applied to any scale of heating appara- tus.

Figure 8:
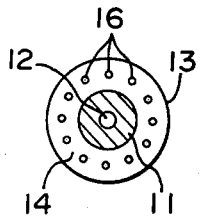
FIGS. 8 through 10 are respectively rear views showing arrangement of outflow passageways.
Figure 9:
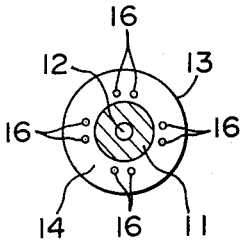
Figure 10:
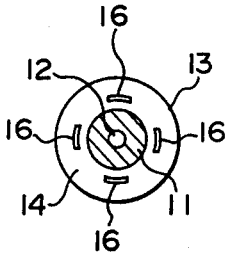

While, in general, the outflow passageways 16 are arranged in equally spaced relation in the inclined por- tion 14 of the frustoconical portion 13 as shown in FIG. 8, it will be appreciated that the outflow passageways 16 may be disposed so as to divide them into coarse portions and close portions as shown in FIG. 9 or may be disposed suitably in spaced relation in the form of a laterally elongated slit to produce divided flames at the time of combustion, and as a result, it is possible to expect reduction in generation of injurious nitrogen oxide.

The present inventor has conducted various measurements in connection with the second, third and fourth embodiment of the present invention to obtain characteristic curves of atomization as shown in FIGS. 11 and 12.

That is, the characteristic curve of atomization for the burner (FIG. 5) in the second embodiment is as shown in FIG. 11—(3) and FIG. 12—(3), in which extremely fine particles of the ratio between the air flow rate Qa and the amount of fuel consumption Qb, i.e. the ratio between the flow rate and the volume (Qa/Qb) $4\times10^3$ and the average particle size $100\mu$ can be flowed in the liquid amount of about 70 l/hr. The characteristic curve of atomization for the burner (FIG. 6) in the third embodiment is as shown in FIG. 11—(4) and FIG. 12—(4), in which even if the ratio between flow rate and the volume (Qa/Qb) is about $2\times10^3$, the average particle size is less than $90\mu$ and the greater the ratio between the flow rate and the volume (Qa/Qb), the smaller will be the particle size. Also, even if the liquid flow is about 150 l/hr, the average particle size is less than $100\mu$. Further, the characteristic curve of atomization for the burner (FIG. 7) in the fourth embodiment is as shown in FIG. 11—(5) and FIG. 12—(5) in which even if the ratio between the flow rate and the volume (Qa/Qb) is $\mathbf{2\times10^3}$, the average particle size of the extremely fine particles is less than $75\mu$, and even if the liquid flow is about 200 l/hr, the average particle size is less than $100\mu$.

In normal heating apparatus, if the average particle size of a group of atomizing droplets of fuel is less than $100\mu$, it will suffice, and accordingly, if the ratio between the flow rate and the volume (Qa/Qb) in each of the embodiments in the present invention is $4\times10^3$, marked effects result to increase the practical value. It will be noted that the amount of air in the aforesaid ratio between the flow rate and the volume (Qa/Qb) is less than one half of the theoretical amount of combustion air. Accordingly, extra air may be freely introduced as a secondary air to enhance the combustion performance.

The burners in the respective embodiments of the present invention have the most noticeable effect in the case the fuel is liquid, but gases may be used as fuel without modification.

What is claimed is:

1. A burner for combustion apparatus comprising an atomizer and a nozzle within said atomizer to define an air passageway therebetween, said nozzle defining an axial fuel passageway disposed interiorly of said nozzle, a tip portion, a first frustoconical portion diverging in the downstream direction a first conical portion converging in the downstream direction extending from the widest portion of the first frustoconical portion, said first frustoconical portion and said first conical portion blocking said tip portion, said first frustoconical portion diverging from said tip portion toward the extreme end of said nozzle and defining a plurality of fuel outflow passageways connected to said axial fuel passageway, said fuel outflow passageways being positioned to flow fuel backwardly from the fuels forwardmost position in the axial fuel passageway until met by air passing over the diverging first frustonical portion, and a second frustoconical portion diverging in the downstream direction extending from the narrowest portion of said first conical portion converging in the downstream direction.

2. The burner of claim 1 including a second conical portion converging in the downstream direction extending from the widest portion of said second frustoconical portion diverging in the downstream direction.

* * * * *